US008268762B2

(12) United States Patent
Fujita

(10) Patent No.: US 8,268,762 B2
(45) Date of Patent: Sep. 18, 2012

(54) TRANSMISSION FLUID COMPOSITION

(75) Inventor: Hiroshi Fujita, Chiba (JP)

(73) Assignee: Idemitsu Kosan Co., Ltd., Tokyo (JP)

( * ) Notice: Subject to any disclaimer, the term of this patent is extended or adjusted under 35 U.S.C. 154(b) by 581 days.

(21) Appl. No.: 12/093,733

(22) PCT Filed: Nov. 15, 2006

(86) PCT No.: PCT/JP2006/322763

§ 371 (c)(1),
(2), (4) Date: Aug. 5, 2008

(87) PCT Pub. No.: WO2007/058213

PCT Pub. Date: May 24, 2007

(65) Prior Publication Data

US 2010/0062954 A1 Mar. 11, 2010

(30) Foreign Application Priority Data

Nov. 15, 2005 (JP) ..... 2005-330825
Nov. 15, 2005 (JP) ..... 2005-330831

(51) Int. Cl.
*C10L 1/16* (2006.01)
*C10G 71/00* (2006.01)
*C10M 159/00* (2006.01)

(52) U.S. Cl. ..... 508/591; 208/18; 208/19

(58) Field of Classification Search ..... 508/591; 208/18, 19

See application file for complete search history.

(56) References Cited

U.S. PATENT DOCUMENTS 5,089,156 A * 2/1992 Chrisope et al. ..... 508/161
2001/0041818 A1 11/2001 Bagheri et al.

FOREIGN PATENT DOCUMENTS

| | | |
|---|---|---|
| JP | 07 133234 | 5/1995 |
| JP | 2001 089779 | 4/2001 |
| JP | 2002 518582 | 6/2002 |
| JP | 2003 528174 | 9/2003 |
| JP | 2004 262979 | 9/2004 |
| JP | 2005 501957 | 1/2005 |
| WO | WO 99/67347 | 12/1999 |
| WO | 2006 073198 | 7/2006 |
| WO | 2006 120925 | 11/2006 |

OTHER PUBLICATIONS

Ronald L. Shubkin, "Polyalphaolefins", CRC Handbook of Lubrication and Tribology, Theory of Tribology, Jan. 1, 1993, XP 009108705, pp. 219-235.

R. L. Shubkin, et al., "Tailor-making Polyalphaolefins", Journal of Synthetic Lubrication, vol. 8, No. 2, Jul. 1991, XP002588264, pp. 115-134.

* cited by examiner

*Primary Examiner* — Walter D Griffin
*Assistant Examiner* — Francis C Campanell
(74) *Attorney, Agent, or Firm* — Oblon, Spivak, McClelland, Maier & Neustadt, L.L.P.

(57) ABSTRACT

The invention provides a transmission fluid composition which has a kinematic viscosity as determined at 100° C. of 2 to 10 $mm^2/s$ and a viscosity index of 150 or higher and which satisfies a relationship between kinematic viscosity and NOACK evaporation loss amount represented by formula (I):

$$X/3+Y \leqq 6.33 \quad (I)$$

(wherein X represents a kinematic viscosity ($mm^2/s$) as determined at 100° C., and Y represents a NOACK evaporation loss amount (mass %) at 200° C. for one hour), and a transmission fluid composition containing, as a base oil, at least one species selected from among α-olefin oligomers produced through oligomerization of an α-olefin through a specific method and hydrogenation products of the oligomers. Such transmission fluid compositions exhibit a very small evaporation loss despite having low viscosity, and a long metal fatigue life (e.g., pitting resistance) and have high viscosity index, good low-temperature fluidity, good extreme pressure properties, and good oxidation stability, and are suitable for transmissions, particularly automatic transmissions.

19 Claims, No Drawings

TRANSMISSION FLUID COMPOSITION

TECHNICAL FIELD

The present invention relates to transmission fluid compositions. More particularly, the invention relates to transmission fluid compositions which exhibit a small evaporation loss despite having low viscosity, a long metal fatigue life (e.g., pitting resistance), and good oxidation stability, and which are suitable for transmissions, particularly automatic transmissions.

BACKGROUND ART

In recent years, coping with environmental problems, such as global warming, and resource conservation have become imminent issue in human society. Therefore, continuous research and development efforts have been made to save fuel and energy in automobiles, machines, apparatus, including industrial machines, etc. The role of lube oil employed in such machines and apparatus is basically to attain stable operation of the machines and apparatus, but demand has arisen to reduce wear and friction to thereby enhance a fuel saving effect.

One known effective means for saving fuel cost is reducing viscosity of lube oil. For example, when the viscosity of lube oil employed in an automatic transmission (AT) having a torque converter, a gear bearing mechanism, a hydraulic mechanism, a wet clutch, etc. is reduced, fluid resistance (stirring resistance) of the members is reduced, conceivably lowering fuel cost.

However, when the viscosity of lube oil is lowered, the lube oil is prone to vaporize, and as a result, evaporation loss increases. This also causes an increase in viscosity of the lube oil during operation.

In addition, reduction of the viscosity of lube oil decreases the fatigue life of such machines. Specifically, metal fatigue such as scoring or spalling occurs at a gear bearing mechanism and other friction parts, and lubrication characteristics such as extreme pressure characteristics are impaired. Particularly, since the sizes and weights of ATs have decreased and torque capacity has increased in recent years, gear bearings receive an increased load. Also, since automobiles of an AT of larger number of gear positions such as a 6-speed AT have increased, a gear (planetary pinions) is operated under high-speed rotation, which causes high-speed friction against a bearing. Thus, metal fatigue and lubrication characteristics have become severe problems.

Furthermore, a transmission fluid is required to have good oxidation stability.

One example of such a conventional transmission fluid whose viscosity is reduced so as to save fuel cost is a transmission fluid produced through blending a base oil having a naphthene content and an aromatic content controlled to fall within specific levels with a specific extreme-pressure agent (see, for example, Patent Document 1). However, such a lube oil exhibits a large evaporation loss and has other problems. Thus, such a lube oil is required to be further improved.

Patent Document 1: Japanese Patent Application laid-Open (kokai) No. 2004-262979

DISCLOSURE OF THE INVENTION

Under such circumstances, an object of the present invention is to provide transmission fluid compositions, which exhibit a very small evaporation loss despite having low viscosity, and a long metal fatigue life (e.g., pitting resistance) and have high viscosity index, good low-temperature fluidity, good extreme pressure properties, and good oxidation stability, and which are suitable for transmissions, particularly automatic transmissions.

The present inventor has carried out extensive studies for the development of a transmission fluid composition having the aforementioned advantageous properties, and has found that the object can be attained through employment of a transmission fluid composition having a specific kinematic viscosity, a specific viscosity index, and a specific relationship between kinematic viscosity and NOACK evaporation loss amount. The present inventor has also found that the object can also be attained through employment of a transmission fluid composition comprising a base oil which contains at least one species selected from among an α-olefin oligomer which has been produced in the presence of a metallocene catalyst and which has a specific number of carbon atoms; a hydrogenation product of the α-olefin oligomer; an α-olefin oligomer which has been derived from an α-olefin dimer produced in the presence of a metallocene catalyst and which has a specific number of carbon atoms; and a hydrogenation product of the α-olefin oligomer. The present invention has been accomplished on the basis of these findings.

Accordingly, the present invention provides the following:

(1) a transmission fluid composition which has a kinematic viscosity as determined at 100° C. of 2 to 10 $mm^2/s$ and a viscosity index of 150 or higher and which satisfies a relationship between kinematic viscosity and NOACK evaporation loss amount represented by formula (I):

$$X/3+Y\leqq 6.33 \quad \text{(I)}$$

(wherein X represents a kinematic viscosity ($mm^2/s$) as determined at 100° C., and Y represents a NOACK evaporation loss amount (mass %) at 200° C. for one hour);

(2) a transmission fluid composition, comprising a base oil which contains at least one species selected from among (A) a C16 to C40 α-olefin oligomer which has been produced through oligomerization of a C2 to C20 α-olefin in the presence of a metallocene catalyst;

(B) a hydrogenation product of the α-olefin oligomer (A);

(C) a C16 to C56 α-olefin oligomer which has been produced through dimerization of a C2 to C20 α-olefin in the presence of a metallocene catalyst, to thereby form an α-olefin dimer having a vinylidene bond, and through further dimerization of the α-olefin dimer in the presence of an acid catalyst;

(D) a hydrogenation product of the α-olefin oligomer (C);

(E) a C16 to C40 α-olefin oligomer which has been produced through dimerization of a C2 to C20 α-olefin in the presence of a metallocene catalyst, to thereby form an α-olefin dimer having a vinylidene bond, and through addition of a C6 to C8 α-olefin to the α-olefin dimer in the presence of an acid catalyst; and (F) a hydrogenation product of the α-olefin oligomer (E);

(3) a transmission fluid composition as described in (1) above, which comprises as a base oil an α-olefin oligomer and/or an α-olefin oligomer hydrogenation product;

(4) a transmission fluid composition as described in (3) above, wherein the α-olefin oligomer and the α-olefin oligomer hydrogenation product are at least one species selected from among (A) a C16 to C40 α-olefin oligomer which has been produced through oligomerization of a C2 to C20 α-olefin in the presence of a metallocene catalyst;

(B) a hydrogenation product of the α-olefin oligomer (A);

(C) a C16 to C56 α-olefin oligomer which has been produced through dimerization of a C2 to C20 α-olefin in the presence of a metallocene catalyst, to thereby form an α-olefin dimer having a vinylidene bond, and through further dimerization of the α-olefin dimer in the presence of an acid catalyst;

(D) a hydrogenation product of the α-olefin oligomer (C);

(E) a C16 to C40 α-olefin oligomer which has been produced through dimerization of a C2 to C20 α-olefin in the presence of a metallocene catalyst, to thereby form an α-olefin dimer having a vinylidene bond, and through addition of a C6 to C8 α-olefin to the α-olefin dimer in the presence of an acid catalyst; and (F) a hydrogenation product of the α-olefin oligomer (E);

(5) a transmission fluid composition as described in (2) or (4) above, wherein the base oil contains at least one species selected from among components (A) to (F) in an amount of 10 to 100 mass;

(6) a transmission fluid composition as described in (1) or (2) above, which contains at least one species selected from among an extreme-pressure agent, an oiliness agent, an antioxidant, a rust-preventive agent, a metal deactivator, a detergent dispersant, a viscosity index improver, a pour point depressant, and a defoamer;

(7) a transmission fluid composition as described in (1) above, which has a kinematic viscosity as determined at 100° C. of 3 to 8 $mm^2/s$;

(8) a transmission fluid composition as described in (2) above, which has a kinematic viscosity as determined at 100° C. of 2 to 20 $mm^2/s$; and (9) a transmission fluid composition as described in (1) or (2) above, which is for use in an automatic transmission.

According to the present invention, there can be provided transmission fluid compositions, which exhibit a very small evaporation loss despite having low viscosity, a long metal fatigue life (e.g., pitting resistance) and have high viscosity index, good low-temperature fluidity, good extreme pressure properties, and good oxidation stability.

BEST MODES FOR CARRYING OUT THE INVENTION

The present invention encompasses a transmission fluid composition which has a kinematic viscosity as determined at 100° C. of 2 to 10 $mm^2/s$ and a viscosity index of 150 or higher and which satisfies a relationship between kinematic viscosity and NOACK evaporation loss amount represented by formula (I) (a first invention) and a transmission fluid composition, comprising a base oil which contains at least one species selected from among the α-olefin oligomers and hydrogenation products thereof serving as the aforementioned components (A) to (F) (a second invention).

The first invention will now be described.

The transmission fluid compositions according to the first invention has a kinematic viscosity as determined at 100° C. of 2 to 10 $mm^2/s$. When the kinematic viscosity as determined at 100° C. is 2 $mm^2/s$ or higher, a long fatigue life and good extreme pressure characteristics can be ensured, whereas the kinematic viscosity is 10 $mm^2/s$ or lower, fuel cost can be sufficiently saved. The kinematic viscosity as determined at 100° C. is preferably 3 to 8 $mm^2/s$, more preferably 4 to 7 $mm^2/s$.

The transmission fluid compositions according to the invention has a viscosity index of 150 or higher. When the viscosity index is lower than 150, low-temperature fluidity is impaired. In the case such compositions are employed in cold areas, fluid resistance increases, and cost saving cannot fully be attained. The viscosity index is preferably 154 or higher, more preferably 155 or higher, particularly preferably 160 or higher.

The transmission fluid compositions according to the present invention are required to satisfy a relationship between kinematic viscosity and NOACK evaporation loss amount represented by formula (I):

$$X/3+Y\leqq 6.33 \quad \text{(I)}$$

(wherein X represents a kinematic viscosity ($mm^2/s$) as determined at 100° C., and Y represents a NOACK evaporation loss amount (mass %) at 200° C. for one hour). When the transmission fluid compositions do not satisfy formula (I), evaporation loss may increase at a kinematic viscosity which the compositions require to have. In such a case, the effect of the present invention may fail to be attained satisfactorily.

The transmission fluid compositions according to the present invention preferably satisfy a relationship between kinematic viscosity and NOACK evaporation loss amount represented by formula (I-a):

$$0.3X+Y\leqq 5.8 \quad \text{(I-a)},$$

more preferably represented by formula (I-b):

$$0.25X+Y\leqq 5.25 \quad \text{(I-b)}$$

The kinematic viscosity is determined in accordance with JIS K2283, and the NOACK evaporation loss amount (mass %) is determined at 200° C. for one hour in accordance with the standard JPI-5S-41-93 (Japan Petroleum Institute).

The transmission fluid compositions of the present invention preferably employ a base oil containing an α-olefin oligomer and/or an α-olefin oligomer hydrogenation product. Particularly, the compositions preferably contain at least one species selected from among α-olefin oligomers and hydrogenation products of the α-olefin oligomers of the components (A) to (F) in an amount of 10 to 100 mass, more preferably 20 to 100 mass, still more preferably 25 to 100 mass, particularly preferably 50 to 100 mass. When the base oil contains such an α-olefin oligomer or a hydrogenation product thereof in an amount of 10 mass % or more, a transmission fluid composition which exhibits a small evaporation loss, a long metal fatigue life, and enhanced extreme pressure characteristics and oxidation stability can be readily produced.

[(A) α-Olefin Oligomer]

The α-olefin oligomer (component (A)) preferably employed in the base oil is a C16 to C40 α-olefin oligomer which has been produced through oligomerization of a C2 to C20 α-olefin in the presence of a metallocene catalyst. When the number of carbon atoms of the α-olefin oligomer is 16 to 40, a base oil exhibiting excellent low-temperature fluidity, evaporation resistance, and oxidation stability can be produced, and a transmission fluid composition employing the base oil attains the object of the present invention. The α-olefin oligomer preferably has 20 to 34 carbon atoms.

Examples of the starting C2 to C20 α-olefin include ethylene, propylene, 1-butene, 1-pentene, 1-hexene, 1-heptene, 1-octene, 1-nonene, 1-decene, 1-undecene, 1-dodecene, 1-tridecene, 1-tetradecene, 1-pentadecene, 1-hexadecene, 1-heptadecene, 1-octadecene, 1-nonadecene, and 1-icocene. These α-olefins may be linear or branched. In the present invention, these α-olefins may be used singly or in combination of two or more species.

In the present invention, known catalysts may be employed as the metallocene catalyst employed in oligomerization of α-olefin. For example, a combination of (a) a metallocene complex containing a Group 4 (periodic table) element, (b)

(b-1) a compound which can form an ionic complex through reaction with the metallocene complex (a) or a derivative thereof and/or (b-2) aluminoxane, and (c) an optional organic aluminum compound may be used.

The metallocene complex containing a Group 4 (periodic table) element (a) employed in the invention may be a complex having a conjugated 5-membered carbon ring and containing titanium, zirconium, or hafnium (preferably zirconium). Typical examples of the complex having a conjugated 5-membered carbon ring include complexes having a substituted or unsubstituted cyclopentadienyl ligand.

Examples of the metallocene complex serving as the catalyst component (a) include known compounds, specifically, bis(n-octadecylcyclopentadienyl)zirconium dichloride, bis(trimethylsilylcyclopentadienyl)zirconium dichloride, bis(tetrahydroindenyl)zirconium dichloride, bis[(t-butyldimethylsilyl)cyclopentadienyl]zirconium dichloride, bis(di-t-butylcyclopentadienyl)zirconium dichloride, ethylidenebis(indenyl)zirconium dichloride, biscyclopentadienylzirconium dichloride, ethylidenebis(tetrahydroindenyl)zirconium dichloride, and bis[3,3-(2-methyl-benzindenyl)]dimethylsilanediylzirconium dichloride, (1,2'-dimethylsilylene)(2,1'-dimethylsilylene)bis(3-trimethylsilylmethylindenyl)zirconium dichloride.

These metallocene complex may be used singly or in combination of two or more species.

Examples of the (b-1) compound which can form an ionic complex through reaction with the metallocene complex (a) or a derivative thereof include borate compounds such as dimethylanilinium tetrakis(pentafluorophenylborate) and triphenylcarbenium tetrakis(pentafluorophenylborate). These compounds may be used singly or in combination of two or more species.

Examples of the aluminoxane serving as the (b-2) compound include chain aluminoxanes such as methylaluminoxane, ethylaluminoxane, butylaluminoxane, and isobutylaluminoxane, and cyclic aluminoxanes. These aluminoxane may be used singly or in combination of two or more species.

In the present invention, as the catalyst component (b), one or more compounds (b-1) or one or more compounds (b-2) may be used. Alternatively, one or more compounds (b-1) and one or more compounds (b-2) may be used in combination.

When the compound (b-1) is employed as the catalyst component (b), the ratio by mole of catalyst component (a) to catalyst component (b) is preferably 10:1 to 1:100, more preferably 2:1 to 1:10. When the ratio falls outside the range, the cost of catalyst per mass of polymer increases, which is not suited for production in practice. When the compound (b-2) is employed, the mole ratio is preferably 1:1 to 1:1,000,000, more preferably 1:10 to 1:10,000. When the ratio falls outside the range, the cost of catalyst per mass of polymer increases, which is not suited for production in practice.

Examples of the organic aluminum compound serving as the optional catalyst component (c) include trimethylaluminum, triethylaluminum, triisopropylaluminum, triisobutylaluminum, dimethylaluminum chloride, diethylaluminum chloride, methylaluminum dichloride, ethylaluminum dichloride, dimethylaluminum fluoride, diisobutylaluminum hydride, diethylaluminum hydride, and ethylaluminum sesquichloride.

These organic aluminum compounds may be used singly or in combination of two or more species.

When the catalyst components (a) and (c) are employed, the ratio by mole of catalyst component (a) to catalyst component (c) is preferably 1:1 to 1:10,000, more preferably 1:5 to 1:2,000, still more preferably 1:10 to 1:1,000. Through employment of the catalyst component (c), polymerization activity per amount of transition metal can be enhanced. However, use of an excessive amount of the catalyst component (c) is disadvantageous, and an organic aluminum species not involved in reaction remains in a large amount in the polymer.

When the catalyst is prepared from the catalyst components (a) and (b), material contact is preferably performed in an inert gas atmosphere such as nitrogen.

When the catalyst is prepared from the catalyst components (a) and (b) and the organic aluminum compound (c), the catalyst component (b) may be brought into contact with the organic aluminum compound (c) in advance. Alternatively, through treating the components (a), (b), and (c) together in the presence of α-olefin, a catalyst exhibiting sufficiently high activity can be produced.

The aforementioned catalyst components may be prepared in a catalyst preparation tank before use, or in a oligomerization step.

Oligomerization of α-olefin may be performed in a batch manner or a continuous manner. Oligomerization requires no particular solvent and may be performed in suspension, monomer liquid, or inert solvent. In the case of oligomerization in solvent, liquid hydrocarbon such as benzene, ethylbenzene, or toluene is employed. Preferably, oligomerization is performed in a reaction mixture where monomer liquid is present in an excessive amount.

Oligomerization is performed at about 15 to about 100° C. under atmospheric pressure to about 0.2 MPa. The catalyst is generally used in an amount with respect to α-olefin; i.e., a mole ratio α-olefin/metallocene complex (A) of 1,000 to $10^6$, preferably 2,000 to $10^5$. The reaction time is generally about 10 minutes to about 48 hours.

The oligomerization is followed by a post-treatment. In the post-treatment, the reaction system is deactivated through a known method, for example, adding water or alcohol thereto, to thereby terminate oligomerization, and de-ashed by use of an aqueous alkaline solution or an alcoholic alkaline solution. Subsequently, washing for neutralization, distillation, etc. are performed. Unreacted α-olefin and olefin isomers by-produced during oligomerization are removed through stripping, whereby an α-olefin oligomer having a polymerization degree of interest is isolated.

Thus, the α-olefin oligomer produced in the presence of a metallocene catalyst possesses a double bond, with a particularly high terminal vinylidene bond content.

The α-olefin oligomer generally has a terminal-vinylidene-bond structure represented by formula (II):

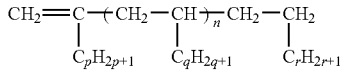

(II)

(wherein p, q, and r each are an integer of 0 to 18, and n is an integer of 0 to 8; when n is ≧2, a plurality of qs in individual repeating units may be identical to or different from one another; and p+n×(2+q)+r is 12 to 36).

[(B) Hydrogenation Product of α-Olefin Oligomer]

The hydrogenation product of the α-olefin oligomer which serves as the component (B) and is preferably employed in the base oil is a hydrogenation product of the α-olefin oligomer (A) and may be produced through a known hydrogenation procedure of the α-olefin oligomer which has been isolated in the aforementioned manner and which has a polymerization degree of interest. Alternatively, the hydrogenation product may be produced through performing de-ashing, neutralization, and washing after oligomerization; hydrogenating without isolating the α-olefin oligomer through distillation; and isolating, through distillation, a hydrogenation product of the α-olefin oligomer having a polymerization degree of interest.

Hydrogenation of the α-olefin oligomer is performed in the presence of a known hydrogenation catalyst, for example, Ni- or Co-based catalyst; a noble metal catalyst such as Pd or Pt. Specific examples include an Ni-on-diatomeceous earth catalyst, a cobalt trisacetylacetonate/organic aluminum catalyst, a palladium-on-activated carbon catalyst, and a platinum-on-alumina catalyst.

When a Ni-based catalyst is employed, hydrogenation is generally performed at 150 to 200° C. When a noble metal catalyst such as Pd or Pt is employed, hydrogenation is generally performed at 50 to 150° C. When a homogeneous catalyst such as a cobalt trisacetylacetonate/organic aluminum catalyst is employed, hydrogenation is generally performed at 20 to 100° C. In any case, hydrogen pressure is ambient pressure to about 20 MPa.

When the reaction temperature at each catalyst falls within the corresponding range, an appropriate rate of reaction can be attained, and formation of another isomer of the oligomer having the same polymerization degree can be prevented.

The α-olefin oligomer hydrogenation product generally has a structure represented by formula (III):

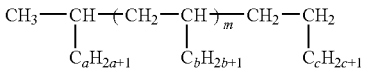

(III)

(wherein a, b, c, and m have the same meaning as defined in relation to p, q, r, and n in formula (II)).

The α-olefin oligomer hydrogenation product is more preferable in terms of, for example, oxidation stability than the α-olefin oligomer (A) having a terminal vinylidene bond.

[(C) α-Olefin Oligomer]

The α-olefin oligomer which serves as the component (C) and is preferably employed in the base oil is a C16 to C56 α-olefin oligomer which has been produced through dimerization of a C2 to C20 α-olefin in the presence of a metallocene catalyst, to thereby form an α-olefin dimer having a vinylidene bond, and through further dimerization of the α-olefin dimer in the presence of an acid catalyst. The α-olefin oligomer preferably has 16 to 48 carbon atoms, more preferably 16 to 40 carbon atoms.

The starting C2 to C20 α-olefin is the same as described in relation to the component (A). In the present invention, α-olefins may be used singly or in combination of two or more species.

The metallocene catalyst employed in dimerization of the α-olefin, dimerization reaction conditions, post-treatment, etc. are the same as described in relation to the α-olefin oligomer of the component (A).

In present invention, the α-olefin dimer produced in the presence of a metallocene catalyst (hereinafter may be referred to as vinylidene olefin) is further dimerized in the presence of an acid catalyst. In this case, the same vinylidene olefins may be reacted with each other, or different vinylidene olefins may be reacted.

In the latter dimerization, an acid catalyst such as a Lewis acid catalyst or a solid acid catalyst may be employed. From the viewpoints of post treatment facility or other factors, a solid acid catalyst is preferred.

Examples of the solid acid catalyst include acidic zeolite, acidic zeolite molecular sieve, clay minerals treated with acid, porous desiccants treated with acid, and ion-exchange resin. Specific examples of the solid acid catalyst include acidic zeolite such as HY zeolite; acidic zeolite molecular sieve having a pore size of about 0.5 to 2 nm; clay minerals such as silica-alumina, silica-magnesia, montmorillonite, and halloysite, treated with an acid such as sulfuric acid; porous desiccants such as silica gel and alumina gel, on which hydrochloric acid, sulfuric acid, phosphoric acid, organic acid, $BF_3$, or the like has been deposited; and ion-exchange resin such as divinylbenzene-styrene copolymer sulfonate.

The solid acid catalyst is generally added in an amount 0.05 to 20 parts by mass to 100 parts by mass of vinylidene olefin. When the amount of solid acid catalyst is in excess of 20 parts by mass, cost increases, and side reaction proceeds, possibly resulting in an increase in viscosity of the reaction mixture or a drop in yield. When the amount is lower than 0.05 parts by mass, reaction efficiency decreases, prolonging the reaction time.

The amount of solid acid catalyst, which depends on the acidity thereof, is preferably 3 to 15 parts by mass (in the case of montmorillonite clay mineral treated with sulfuric acid) with respect to 100 parts by mass of vinylidene olefin or 1 to 5 parts by mass (divinylbenzene-styrene copolymer sulfonate ion-exchange resin). Depending on reaction conditions, two or more species of these solid acid catalysts may be used in combination.

The reaction is generally performed at 50 to 150° C. The reaction temperature of 70 to 120° C. is preferred, since catalytic activity and selectivity can be enhanced. The reaction pressure is atmospheric to about 1 MPa. The effect of reaction pressure on the reaction is small.

Dimerization of the vinylidene olefin forms a C16 to C56 vinylidene olefin dimer, which is an α-olefin oligomer (C) represented by formula (IV) or (V):

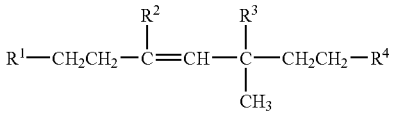

(IV)

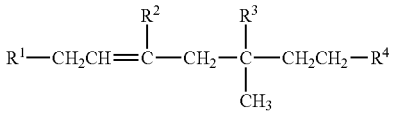

(V)

(wherein $R^1$ to $R^4$ each represent a hydrogen atom or a C1 to C18 linear or branched alkyl group, and the total number of carbon atoms in $R^1$ to $R^4$ is 8 to 48).

Other than the vinylidene olefin dimer, the dimerization mixture contains an unreacted vinylidene olefin, a vinylidene olefin trimer, etc. Therefore, after removal of the solid acid catalyst from the dimerization mixture through filtration, the vinylidene olefin dimer represented by formula (IV) or (V) may be isolated through an optional distillation procedure.

[(D) Hydrogenation Product of α-Olefin Oligomer]

The hydrogenation product of the α-olefin oligomer which serves as the component (D) and is preferably employed in the base oil may be produced through hydrogenating a reaction mixture containing a vinylidene olefin dimer which has been produced in the aforementioned procedure and from which the solid acid catalyst has been removed, or hydrogenating a vinylidene olefin dimer isolated from the reaction mixture through distillation. When the reaction mixture is hydrogenated, the hydrogenation product of the vinylidene olefin dimer may be isolated through an optional distillation procedure.

The hydrogenation catalyst, reaction conditions, etc. are the same as described in relation to the α-olefin oligomer hydrogenation product of the component (B).

Thus, the α-olefin oligomer hydrogenation product WO, which is a C16 to C56 vinylidene olefin dimer hydrogenation product represented by formula (VI):

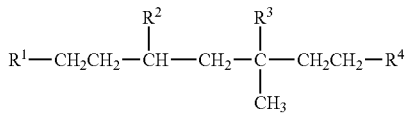

(VI)

(wherein $R^1$ to $R^4$ have the same meanings as defined above) is produced.

The α-olefin oligomer hydrogenation product (D) is more preferable in terms of, for example, oxidation stability than the α-olefin oligomer (C).

[(E) α-Olefin Oligomer]

The α-olefin oligomer which serves as the component (E) and is preferably employed in the base oil is a C16 to C40 α-olefin oligomer which has been produced through dimerization of a C2 to C20 α-olefin in the presence of a metallocene catalyst, to thereby form an α-olefin dimer having a vinylidene bond, and through addition of a C6 to C8 α-olefin to the α-olefin dimer in the presence of an acid catalyst. The α-olefin oligomer preferably has 20 to 34 carbon atoms.

The starting C2 to C20 α-olefin is the same as described in relation to the component (A). In the present invention, α-olefins may be used singly or in combination of two or more species.

The metallocene catalyst employed in dimerization of the α-olefin, dimerization reaction conditions, post-treatment, etc. are the same as described in relation to the α-olefin oligomer of the component (A).

In the present invention, a C6 to C8 α-olefin is added, in the presence of an acid catalyst, to the α-olefin dimer (vinylidene olefin) which has been produced in the presence of a metallocene catalyst.

The type and amount of the acid catalyst employed in the reaction, the reaction conditions, etc. are the same as described in relation to dimerization of vinylidene olefin to form the aforementioned α-olefin oligomer (C). Examples of the C6 to C8 α-olefin include 1-hexene, 1-heptene, and 1-octene. These α-olefins may be linear or branched. In the present invention, α-olefins may be used singly or in combination of two or more species.

The addition forms a C16 to C40 α-olefin oligomer (E) represented by formula (VII):

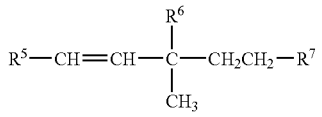

(VII)

(wherein $R^5$ represents a C4 to C6 alkyl group; $R^6$ and $R^7$ each represent a hydrogen atom or a C1 to C18 alkyl group, and the total number of carbon atoms in $R^5$ to $R^7$ is 10 to 34).

In formula (VII), the C4 to C6 alkyl group ($R^5$) may be linear or branched, and the C1 to C18 alkyl group in $R^6$ or $R^7$ may be linear or branched.

After completion of reaction, the solid acid catalyst is removed from the dimerization mixture through filtration, and the α-olefin oligomer represented by formula (VII) may be isolated through an optional distillation procedure.

[(F) Hydrogenation Product of α-Olefin Oligomer]

The hydrogenation product of the α-olefin oligomer which serves as the component (F) and is preferably employed in the base oil may be produced through hydrogenating a reaction mixture containing an α-olefin oligomer (VII) which has been produced in the aforementioned procedure and from which the solid acid catalyst has been removed, or hydrogenating an α-olefin oligomer isolated from the reaction mixture through distillation. When the reaction mixture is hydrogenated, the hydrogenation product of the α-olefin oligomer may be isolated through an optional distillation procedure.

The hydrogenation catalyst, reaction conditions, etc. are the same as described in relation to the α-olefin oligomer hydrogenation product of the component (B).

Thus, the α-olefin oligomer hydrogenation product (F), which is a C16 to C40 α-olefin oligomer hydrogenation product represented by formula (VIII):

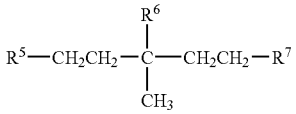

(VIII)

(wherein $R^5$ to $R^7$ have the same meanings as defined above) is produced. The α-olefin oligomer hydrogenation product (F) is more preferable in terms of, for example, oxidation stability than the α-olefin oligomer (E).

The base oil preferably employed in the transmission fluid compositions of the present invention may further contain, in addition to α-olefin oligomer or a hydrogenation product thereof serving as the aforementioned components (A) to (F), an additional base oil in an amount of 90 mass % or less. The amount is preferably 80 mass % or less, more preferably 75 mass % or less, particularly preferably 50 mass % or less.

The additional base oil which may be employed in the compositions is a mineral base oil and/or a synthetic base oil, which are/is generally employed in a transmission fluid.

One examples of the mineral base oil is a refined fraction produced through subjecting a lube oil fraction which has been obtained through distillation of crude oil at ambient pressure and distillation of the residue under reduced pressure, to at least one treatment such as solvent deasphalting, solvent extraction, hydro-cracking, solvent dewaxing, or hydro-refining. Another example of the mineral base oil is a base oil produced through isomerization of mineral oil wax or isomerization of wax (gas-to-liquid wax) produced through, for example, the Fischer-Tropsch process.

These mineral base oil preferably have a viscosity index of 90 or higher, more preferably 100 or higher, still more preferably 110 or higher. When the viscosity index is 90 or higher, the viscosity index of the compositions can be maintained at a high level, whereby the object of the present invention can be readily attained.

The mineral base oil preferably has an aromatic content (% CA) of 3 or less, more preferably 2 or less, still more preferably 1 or less. The sulfur content is preferably 100 ppm bymass or less, more preferably 50 ppm by mass or less.

When % CA is 3 or less and the sulfur content is 100 ppm by mass or less, oxidation stability of the compositions can be satisfactorily maintained.

Examples of the synthetic base oil include α-olefin oligomers produced through a conventional method ($BF_3$ catalyst, Ziegler catalyst, etc.) and hydrogenation products thereof; diesters such as di-2-ethylhexyl adipate and di-2-ethylhexyl sebacate; polyol-polyesters such as trimethylolpropane caprylate and pentaerytheritol-2-ethylhexanoate; aromatic synthetic oils such as alkylbenzene and alkylnaphthalene; polyalkylene glycols; and mixtures thereof. Among them, α-olefin oligomers produced through a conventional method ($BF_3$ catalyst, Ziegler catalyst, etc.) and hydrogenation products thereof are preferred.

Examples of the additional base oil which may be employed in the present invention include mineral base oils, synthetic base oils, and any mixture of at least two species selected thereform. Specific examples include at least one mineral base oil, at least one synthetic base oil, and a mixture of at least one mineral base oil, at least one synthetic base oil.

As mentioned hereinbelow, if needed, the transmission fluid compositions of the present invention may appropriately contain additives conventionally employed in transmission fluid, for example, at least one species selected from among an extreme-pressure agent, an oiliness agent, an antioxidant, a rust-preventive agent, a metal deactivator, a detergent dispersant, a viscosity index improver, a pour point depressant, a deformer, etc.

The second invention will now be described. The second invention is directed to a transmission fluid composition, comprising a base oil which contains at least one species selected from among (A) a C16 to C40 α-olefin oligomer which has been produced through oligomerization of a C2 to C20 α-olefin in the presence of a metallocene catalyst;

(B) a hydrogenation product of the α-olefin oligomer (A);

(C) a C16 to C56 α-olefin oligomer which has been produced through dimerization of a C2 to C20 α-olefin in the presence of a metallocene catalyst, to thereby form an α-olefin dimer having a vinylidene bond, and through further dimerization of the α-olefin dimer in the presence of an acid catalyst;

(D) a hydrogenation product of the α-olefin oligomer (C);

(E) a C16 to C40 α-olefin oligomer which has been produced through dimerization of a C2 to C20 α-olefin in the presence of a metallocene catalyst, to thereby form an α-olefin dimer having a vinylidene bond, and through addition of a C6 to C8 α-olefin to the α-olefin dimer in the presence of an acid catalyst; and (F) a hydrogenation product of the α-olefin oligomer (E).

As the α-olefin oligomers and α-olefin oligomer hydrogenation products serving as the aforementioned components (A) to (F), preferred base oils as exemplified in [(A) α-Olefin oligomer] to [(F) Hydrogenation product of α-olefin oligomer] in the first invention may also be employed.

The transmission fluid compositions preferably contain, as a base oil, at least one species selected from among α-olefin oligomers and hydrogenation products of the α-olefin oligomers of the components (A) to (F) in an amount of 10 to 100 mass, more preferably 20 to 100 mass %, still more preferably 25 to 100 mass %, particularly preferably 50 to 100 mass %. When the base oil contains such an α-olefin oligomer or a hydrogenation product thereof in an amount of 10 mass % or more, a transmission fluid composition which exhibits a small evaporation loss, a long metal fatigue life, and enhanced extreme pressure characteristics and oxidation stability can be readily produced.

The base oil preferably employed in the transmission fluid compositions of the present invention may further contain, in addition to α-olefin oligomer or a hydrogenation product thereof serving as the aforementioned components (A) to (F), an additional base oil in an amount of 90 mass % or less. The amount is preferably 80 mass % or less, more preferably 75 mass % or less, particularly preferably 50 mass % or less. The same additional base oils as exemplified in the first invention may also be used as the additional base oil.

Similar to the first invention, if needed, the transmission fluid compositions of the present invention may appropriately contain additives conventionally employed in transmission fluid, for example, at least one species selected from among an extreme-pressure agent, an oiliness agent, an antioxidant, a rust-preventive agent, a metal deactivator, a detergent dispersant, a viscosity index improver, a pour point depressant, a deformer, etc.

The transmission fluid compositions according to the present invention exhibit a very small evaporation loss despite having low viscosity, a long metal fatigue life (e.g., pitting resistance) and have high viscosity index, good low-temperature fluidity, good extreme pressure properties, and good oxidation stability. The kinematic viscosity as determined at 100° C. is generally about 2 to about 20 $mm^2/s$, preferably 3 to 15 $mm^2/s$, more preferably 2 to 10 $mm^2/s$, particularly preferably 5 to 8 $mm^2/s$. The viscosity index is generally 120 or higher, preferably 140 or higher, more preferably 150 or higher.

As mentioned above, so long as the effects of the present invention are not impaired and if needed, the transmission fluid compositions of the present invention (first and second inventions) may appropriately contains additives conventionally employed in transmission fluid, for example, at least one species selected from among an extreme-pressure agent, an oiliness agent, an antioxidant, a rust-preventive agent, a metal deactivator, a detergent dispersant, a viscosity index improver, a pour point depressant, a deformer, etc.

Examples of preferred extreme-pressure agents include phosphoric acid esters such as phosphate esters, acid phosphate esters, phosphite esters, and acid phosphite esters; amine salts of the phosphoric acid esters; and sulfur-containing extreme-pressure agents.

Examples of the phosphate esters include triaryl phosphates, trialkyl phosphates, trialkylaryl phosphalkyl phosphates, triarylalkyl phosphates, and trialkenyl phosphates. Specific examples include triphenyl phosphate, tricresyl phosphate, benzyl diphenyl phosphate, ethyl diphenyl phosphate, tributyl phosphate, ethyl dibutyl phosphate, cresyl diphenyl phosphate, dicresyl phenyl phosphate, ethylphenyl diphenyl phosphate, di(ethylphenyl)phenyl phosphate, propylphenyl diphenyl phosphate, di(propylphenyl)phenyl phosphate, triethylphenyl phosphate, tripropylphenyl phosphate, butylphenyl diphenyl phosphate, di(butylphenyl)phenyl phosphate, tributylphenyl phosphate, trihexyl phosphate, tri(2-ethylhexyl)phosphate, tridecyl phosphate, trilauryl phosphate, trimyristyl phosphate, tripalmityl phosphate, tristearyl phosphate, and trioleyl phosphate.

Examples of the acid phosphate esters include 2-ethylhexyl acid phosphate, ethyl acid phosphate, butyl acid phosphate, oleyl acid phosphate, tetracosyl acid phosphate, isodecyl acid phosphate, lauryl acid phosphate, tridecyl acid phosphate, stearyl acid phosphate, and isostearyl acid phosphate.

Examples of the phosphite esters include triethyl phosphite, tributyl phosphite, triphenyl phosphite, tricresyl phosphite, tri(nonylphenyl)phosphite, tri(2-ethylhexyl)phosphite, tridecyl phosphite, trilauryl phosphite, triisooctyl phosphite, diphenyl isodecyl phosphite, tristearyl phosphite, and trioleyl phosphite.

Examples of the acid phosphite esters include dibutyl hydrogen phosphite, dilauryl hydrogen phosphite, dioleyl hydrogen phosphite, distearyl hydrogen phosphite, and diphenyl hydrogen phosphite. Among these phosphoric acid esters, tricresyl phosphate and triphenyl phosphate are preferred.

Examples of the amines which form amine salts with the phosphoric acid esters include monosubstituted amines, disubstituted amines, and trisubstituted amines. Examples of the monosubstituted amines include butylamine, pentylamine, hexylamine, cyclohexylamine, octylamine, laurylamine, stearylamine, oleylamine, and benzylamine. Examples of the disubstituted amines include dibutylamine, dipentylamine, dihexylamine, dicyclohexylamine, dioctylamine, dilaurylamine, distearylamine, dioleylamine, dibenzylamine, stearylmonoethanolamine, decylmonoethanolamine, hexylmonopropanolamine, benzylmonoethanolamine, phenylmonoethanolamine, and tolylmonopropanolamine. Examples of the trisubstituted amines include tributylamine, tripentyl amine, trihexylamine, tricyclohexylamine, trioctylamine, trilaurylamine, tristearylamine, trioleylamine, tribenzylamine, dioleylmonoethanolamine, dilaurylmonopropanolamine, dioctylmonoethanolamine, dihexylmonopropanolamine, dibutylmonopropanolamine, oleyldiethanolamine, stearyldipropanolamine, lauryldiethanolamine, octyldipropanolamine, butyldiethanolamine, benzyldiethanolamine, phenyldiethanolamine, tolyldipronanolamine, xylyldiethanolamine, triethanolamine, and tripropanolamine.

Any sulfur-containing extreme-pressure agent may be used, so long as the agent contains in the molecule thereof a sulfur atom and is dissolved or dispersed in a lube base to serve as an extreme-pressure agent or to exhibit excellent friction characteristics. Examples of such extreme pressure agents include sulfidized fats and oils, sulfidized fatty acid, sulfidized esters, sulfidized olefins, dihydrocarbyl polysulfides, thiadiazole compounds, thiophosphoric acid esters (thiophosphites and thiophosphates), alkyl thiocarbamoyl compounds, thiocarbamate compounds, thioterpene compounds, and dialkyl thiodipropionate compounds. The sulfidized fats and oils are produced through reaction of a fat or an oil (e.g., lard, whale oil, vegetable oil, or fish oil) with sulfur or a sulfur-containing compound. Although no particular limitation is imposed on the sulfur content, the content preferably 5 to 30 mass. Specific examples include sulfidized lard, sulfidized rape seed oil, sulfidized castor oil, sulfidized soy bean oil, and sulfidized rice bran oil. Examples of the sulfidized fatty acids include sulfidized oleic acid. Examples of the sulfidized esters include sulfidized methyl oleate and sulfidized octyl ester of rice bran fatty acid.

Examples of preferred dihydrocarbyl polysulfides include dibenzyl polysulfides, dinonyl polysulfides, didodecyl polysulfides, dibutyl polysulfides, dioctyl polysulfides, diphenyl polysulfides, and dicyclohexyl polysulfides.

Specific examples of preferred thiadiazole compounds include 2,5-bis(n-hexyldithio)-1,3,4-thiadiazole, 2,5-bis(n-octyldithio)-1,3,4-thiadiazole, 2,5-bis(n-nonyldithio)-1,3,4-thiadiazole, 2,5-bis(1,1,3,3-tetramethylbutyldithio)-1,3,4-thiadiazole, 3,5-bis(n-hexyldithio)-1,2,4-thiadiazole, 3,6-bis(n-octyldithio)-1,2,4-thiadiazole, 3,5-bis(n-nonyldithio)-1,2,4-thiadiazole, 3,5-bis(1,1,3,3-tetramethylbutyldithio)-1,2,4-thiadiazole, 4,5-bis(n-octyldithio)-1,2,3-thiadiazole, 4,5-bis(n-nonyldithio)-1,2,3-thiadiazole, and 4,5-bis(1,1,3,3-tetramethylbutyldithio)-1,2,3-thiadiazole.

Examples of thiophosphoric acid esters include alkyl trithiophosphites, aryl or alkylaryl thiophosphates, and zinc dialkyl dithiophosphates. Of these, lauryl trithiophosphite, triphenyl thiophosphate, and zinc dilauryl dithiophosphate are particularly preferred.

Specific examples of preferred alkyl thiocarbamoyl compounds include bis(dimethylthiocarbamoyl) monosulfide, bis(dibutylthiocarbamoyl)monosulfide, bis(dimethylthiocarbamoyl)disulfide, bis(dibutylthiocarbamoyl)disulfide, bis(diamylthiocarbamoyl)disulfide, and bis(dioctylthiocarbamoyl)disulfide.

Examples of thiocarbamate compounds include zinc dialkyl dithiocarbamate. Examples of thioterpene compounds include a reaction product between phosphorus pentasulfide and pinene. Examples of dialkyl thiodipropionate compounds include dilauryl thiodipropionate and distearyl thiodipropionate. Among them, thiadiazole compounds and benzyl sulfide are preferred, from the viewpoints of extreme-pressure characteristics, friction characteristics, thermal oxidation stability, etc.

These extreme-pressure agents may be used singly or in combination of two or more species and are generally used in an amount of 0.01 to 10 mass %, based on the total amount of a transmission fluid composition, preferably 0.05 to 5 mass, from the viewpoint of, for example, balance between the effect and the cost.

Examples of the oiliness agent include saturated and unsaturated aliphatic monocarboxylic acids such as stearic acid and oleic acid; polymerized fatty acids such as dimer acid and hydrogenated dimer acid; hydroxyfatty acids such as ricinoleic acid and 12-hydroxystearic acid; saturated and unsaturated aliphatic monoalcohols such as lauryl alcohol and oleyl alcohol; saturated and unsaturated aliphatic monoamines such as stearylamine and oleylamine; and saturated and unsaturated aliphatic monocarboxamides such as lauramide and oleamide.

These oiliness agents may be used singly or in combination of two or more species and are generally used in an amount of 0.01 to 10 mass, based on the total amount of a transmission fluid composition, preferably 0.1 to 5 mass %.

Examples of the antioxidant include an amine-based antioxidants, a phenol-based antioxidant, and a sulfur-based antioxidant.

Examples of the amine-based anti-oxidant include monoalkyldiphenylamines such as monooctyldiphenylamine and monononyldiphenylamine; dialkyldiphenylamines such as 4,4'-dibutyldiphenylamine, 4,4'-dipentyldiphenylamine, 4,4'-dihexyldiphenylamine, 4,4'-diheptyldiphenylamine, 4,4'-dioctyldiphenylamine, and 4,4'-dinonyldiphenylamine; polyalkyldiphenylamines such as tetrabutyldiphenylamine, tetrahexyldiphenylamine, tetraoctyldiphenylamine, and tetranonyldiphenylamine; and naphtylamines such as α-naphthylamine, phenyl-α-naphtylamine, butylphenyl-α-naphtylamine, pentylphenyl-α-naphtylamine, hexylphenyl-α-naphtylamine, heptylphenyl-α-naphtylamine, octylphenyl-α-naphtylamine, and nonylphenyl-α-naphtylamine. Of these, dialkyldiphenylamines are preferred.

Examples of the phenol-based anti-oxidant include monophenolic anti-oxidants such as 2,6-di-tert-butyl-4-methylphenol and 2,6-di-tert-butyl-4-ethylphenol; and diphenolic anti-oxidants such as 4,4'-methylenebis(2,6-di-tert-butylphenol) and 2,2'-methylenebis(4-ethyl-6-tert-butylphenol).

Examples of the sulfur-based antioxidant include phenothiazine, pentaerythritol-tetrakis-(3-laurylthiopropionate), bis(3,5-tert-butyl-4-hydroxybenzyl)sulfide, thiodiethylenebis(3-(3,5-di-tert-butyl-4-hydroxyphenyl))propionate, and 2,6-di-tert-butyl-4-(4,6-bis(octylthio)-1,3,5-triazine-2-methylamino)phenol.

The antioxidants may be used singly or in combination of two or more species and are generally incorporated in an amount of 0.01 to 10 mass % based on the total amount of a transmission fluid composition, preferably 0.03 to 5 mass.

Examples of the rust-preventive agent which may be employed in the invention include alkyl- or alkenyl-succinic acid derivatives such as dodecenylsuccinic acid half esters, octadecenylsuccinic anhydride, and dodecenylsuccinamide; polyhydric alcohol partial esters such as sorbitan monooleate, glycerin monooleate, and pentaerythrtol monooleate; amines such as rosin amine and N-oleylsarcosine; and dialkylphosphite amine salts. These rust-preventive agents may be used singly or in combination of two or more species.

The rust-preventive agents are preferably incorporated in an amount of 0.01 to 5 mass % based on the total amount of a transmission fluid composition, particularly preferably 0.05 to 2 mass.

Examples of the metal deactivator which may be employed in the invention include benzotriazole compounds, thiadiazole compounds, and gallate esters.

These metal deactivators are preferably incorporated in an amount of 0.01 to 0.4 mass % based on the total amount of a transmission fluid composition, particularly preferably 0.01 to 0.2 mass.

Examples of the detergent dispersant include metallic detergent dispersants such as alkaline earth metal sulfonates, alkaline earth metal phenates, alkaline earth metal salicylates, and alkaline earth metal phosphonates, and non-ash dispersants such as alkenylsuccinimides, benzylamine, alkylpolyamines, and alkenylsuccinic acid esters. These detergent dispersants may be used singly or in combination of two or more species.

One preferred combination is perbasic calcium sulfonate having a total base value of 300 to 700 mgKOH/g and succinimide having an alkyl- or alkenyl-substituent which is an average molecular weight of 1,000 to 3,500 and/or a boron-containing-hydrocarbon-substituted succinimide. These detergent dispersants are generally incorporated in an amount of about 0.1 to 30 mass % based on the total amount of a transmission fluid composition, preferably 0.5 to 10 mass %.

Examples of the viscosity index improver include polymethacrylate, dispersion-type polymethacrylate, olefin copolymers (e.g., ethylene-propylene copolymer), dispersion-type olefin copolymers, and styrene copolymers (e.g., styrene-diene hydrogenated copolymer). Examples of the pour point depressant include polymethacrylate.

The viscosity index improver is generally incorporated in an amount of 0.5 to 30 mass % based on the total amount of a transmission fluid composition, preferably 1 to 20 mass.

A preferred defoamer is liquid silicone. Liquid silicone such as methylsilicone, fluorosilicone, and polyacrylate may be employed.

These deformers are preferably incorporated in an amount of 0.0005 to 0.5 mass % based on the total amount of a transmission fluid composition.

EXAMPLES

The present invention will next be described in more detail by way of examples, which should not be construed as limiting the invention thereto.

Characteristics and performance of the transmission fluid compositions produced in the Examples and Comparative Examples were determined as follows.

(1) Kinematic Viscosity

Kinematic viscosity was measured in accordance with JIS (2) Viscosity Index

Viscosity index was measured in accordance with JIS K 2283.

(3) Low-Temperature Viscosity (BF Viscosity)

BF viscosity was measured at −40° C. in accordance with JPI-55-26-85.

(4) NOACK Evaporation Test

Evaporation loss (mass %) was measured in accordance with the standard PI-5S-41-93 (Japan Petroleum Institute) (200° C., 1 hr).

(5) Shell Four Ball Test

Extreme pressure was measured at 1,800 rpm in accordance with ASTM D2783.

(6) Fatigue Life Test

The time required for causing pitting was measured through the rolling four ball test (¾-inch SUJ-2 balls, load: 15 kg, rotation: 2,200 rpm, and oil temperature: 90° C.).

(7) Oxidation Stability Test

The test was performed in accordance with the lube oil oxidation stability test described in CEC-L-48-A (170° C., 192 hours).

Production Example 1

Production of C30 α-Olefin Oligomer Hydrogenation Product (a) Oligomerization of Decene Under a stream of inert gas, a decene monomer (Linealene 10, product of Idemitsu Kosan Co., Ltd.) (4 L, 21.4 mol) was placed in a three-neck flask (capacity: 5 L). To the flask, biscyclopentadienylzirconium dichloride (mass as complex: 1,168 mg, 4 mmol) dissolved in toluene and methylalmoxane (40 mmol as reduced to A1) dissolved in toluene were added. The mixture was stirred at 40° C. for 20 hours, and oligomerization reaction was terminated through addition of methanol (20 mL). Subsequently, the reaction mixture was removed from an autoclave, and 5 mol/L aqueous sodium hydroxide solution (4 L) was added to the mixture, followed by forced stirring at room temperature for four hours. The upper organic layer was removed through phase separation, and unreacted decene and reaction by-products (decene isomers) were removed through stripping.

(b) Hydrogenation of Decene Oligomer

Under a stream of nitrogen, a decene oligomer produced in (a) (3 L) was placed in an autoclave (capacity: 5 L). Cobalt tris(acetylacetonate) (mass as catalyst: 3.0 g) dissolved in toluene and triisobutylaluminum (30 mmol) diluted with toluene were added to the autoclave. After addition, the inside of the autoclave was replaced twice by hydrogen and heated. The reaction temperature and the hydrogen pressure were maintained at 80° C. and 0.9 MPa, respectively. Hydrogenation was immediately proceeded with heat generation. Four hours after initiation of the reaction, the reaction system was cooled, to thereby terminate the reaction. Subsequently, the inside pressure was returned to the ambient pressure, and the content was removed from the autoclave. The obtained reaction product mixture was subjected to simple distillation, whereby a 530 Pa fraction (target compound) was recovered at 240 to 270° C.

Production Example 2

Production of C40 α-Olefin Oligomer Hydrogenation Product (a) Dimerization of Decene To a nitrogen-filled three-neck flask (capacity: 5 L), 1-decene (3.0 kg), a metallocene complex, bis(cyclopentadienyl)zirconium dichloride (so-called zirconcene chloride), (0.9 g, 3 mmol), and methylaluminoxane (product of Albemarle Corporation, 8 mmol as reduced to A1) were sequentially added. The mixture was stirred at room temperature (20° C. or lower). During stirring, the color of the reaction mixture was changed from yellow to reddish brown. Forty-eight hours after initiation of reaction, methanol was added to terminate the reaction. Subsequently, aqueous hydrochloric acid solution was added to the reaction mixture, and the organic layer was washed. Thereafter, the organic layer was distillated in vacuum, to thereby yield 2.5 kg of a fraction of b.p. 120 to 125° C./26.6 Pa (0.2 Torr) (decene dimer). Through gas chromatographic analysis of the fraction, the decene dimer concentration was found to be 99 mass, and the vinylidene olefin ratio of the decene dimer was found to be 97 mole mass.

(b) Steps of Dimerization and Hydrogenation of Decene Dimer

To a nitrogen-filled three-neck flask (capacity: 5 L), the dimer produced in the above step (2.5 kg) and Montmorillonite K-10 (product of Aldrich) (250 g) were added at room temperature, and the mixture was heated to 110° C. with stirring. The dimer was reacted at the temperature for nine hours. After completion of reaction, the reaction mixture was cooled to room temperature, and montmorillonite serving as a catalyst was removed therefrom. Subsequently, the dimerization product was transferred to an autoclave (capacity: 5 L), and 5 mass % Palladium-alumina (5 g) was added. The inside of the autoclave was sequentially filled by nitrogen and hydrogen, and the temperature was elevated. Hydrogenation was performed at a hydrogen pressure of 4.8 MPa for eight hours. After confirmation that absorption of hydrogen had been saturated, the temperature and pressure of the reaction system were returned to the ambient conditions, and a hydrogenation product was removed from the autoclave. Through separation of the catalyst from the hydrogenation product, a colorless transparent oily matter (2.2 kg) was yielded. Through gas chromatographic analysis of the oily matter, C20, C40, and C60 saturated hydrocarbons were found to be formed at 45 mass %, 52 mass %, and 3 mass, respectively.

(c) Isolation and Identification of Hydrogenation Products

Into a distillation flask (capacity: 5 L) placed in a silicone oil bath, the aforementioned oily matter (2.2 kg) was transferred. While the oil bath was heated from room temperature to 150° C., distillation was performed at a vacuum degree of 26.6 Pa (0.2 torr). After C20 saturated hydrocarbon had been distilled out at 150° C., the temperature was elevated and the distillation was maintained at 190° C. and 26.6 Pa (0.2 torr) for 30 minutes. After distillation, 1.2 kg (corresponding to the yield through the total steps of about 40%) of a residue (containing target compound) was yielded. Through gas chromatographic analysis of the residue, C20, C40, and C60 saturated hydrocarbons were found to be formed at 0.3 mass, 92.7 mass, and 7.0 mass.

Examples 1 to 3 and Comparative Examples 1 and 2

Base oils and additives listed in Table 1 were mixed at proportions shown in Table 1, to thereby prepare transmission fluid compositions. The characteristics and performance of the compositions were determined. Table 1 shows the results.

TABLE 1

| | | | | Examples | | | Comp. Ex. 1 | |
|---|---|---|---|---|---|---|---|---|
| | | | | 1 | 2 | 3 | 1 | 2 |
| Lube oil composition formulation (mass %) | Base oil | PAO-1[1)] | | — | — | — | 12.6 | — |
| | | PAO-2[2)] | | — | — | — | 71.4 | 87.5 |
| | | Ester[3)] | | — | 6.0 | 6.0 | 6.0 | — |
| | | mPAO-1[4)] | | 86.3 | 63.5 | 84.0 | — | — |
| | | mPAO-2[5)] | | — | 17.0 | — | — | — |
| | | mPAO content of base oil | | (100.0) | (93.0) | (93.0) | (0) | (0) |
| | | Viscosity index improver OCP[6)] | | | 4.5 | 1.0 | 1.0 | |
| | | Viscosity index improver OCP[7)] | | 2.0 | — | — | — | 0.8 |
| | | Automatic transmission fluid additive-1 package[8)] | | — | 9.0 | 9.0 | 9.0 | — |
| | | Automatic transmission fluid additive-2 package[9)] | | 11.5 | — | — | — | 11.5 |
| | | Other additives[10)] | | 0.2 | — | — | — | 0.2 |
| Properties of lube oil composition | Kinematic viscosity ($mm^2/s$) | | 40° C. | 24.4 | 33.9 | 20.5 | 21.6 | 26.4 |
| | | | 100° C. | 5.37 | 6.85 | 4.69 | 4.79 | 5.45 |
| | Viscosity index | | | 164 | 166 | 155 | 149 | 149 |
| | BF viscosity [−40° C.] (mPa · s) | | | 3,200 | 6,600 | 2,600 | 3,300 | 4,700 |
| Performance of lube oil composition | NOACK [200° C., 1 hr] (mass %) | | | 1.5 | 1.5 | 1.6 | 5.6 | 1.8 |
| | Fatigue life (min) | | | 100 | — | — | — | 45 |
| | Shell EP test 1,800 rpm (N) | | LNL | 618 | — | — | — | 392 |
| | | | WL | 1,961 | — | — | — | 1,961 |
| | | | LWI | 290 | — | — | — | 216 |
| | Oxidation stability test [170° C. × 192 h] | Kinematic viscosity ($mm^2/s$) | 40° C. | | 33.4 | 20.0 | 25.9 | |
| | | | 100° C. | | 6.76 | 4.62 | 5.62 | |
| | | Viscosity index | | | 166 | 154 | 166 | |
| | | Kinematic viscosity ratio | 40° C. | | −1.4 | −2.1 | 19.9 | |
| | | | 100° C. | | −1.2 | −1.5 | 17.4 | |

TABLE 1-continued

| | Examples | | | Comp. Ex. 1 | |
|---|---|---|---|---|---|
| | 1 | 2 | 3 | 1 | 2 |
| Acid value (mgKOH/g) | | 3.45 | 3.54 | 4.77 | |
| Change in acid value (mgKOH/g) | | 1.45 | 1.58 | 2.77 | |
| X/3 + Y | 3.29 | 3.78 | 3.16 | 7.20 | 3.62 |
| 0.3X + Y | 3.11 | 3.55 | 3.01 | 7.04 | 3.44 |
| 0.25X + Y | 2.84 | 3.21 | 2.77 | 6.80 | 3.16 |

[Note]

1)α-Olefin oligomer (DURASYN-162, product of BP Chemicals), which is a 1-decene oligomer produced through a conventional method and having a 40° C. kinematic viscosity of 5 $mm^2/s$ 2)α-Olefin oligomer (DURASYN-164, product of BP Chemicals), which is a 1-decene oligomer produced through a conventional method and having a 40° C. kinematic viscosity of 17 $mm^2/s$ 3)Ester (Unister H334R, product of Nippon Oil Fats Co., Ltd.), having a 40° C. kinematic viscosity of 20 $mm^2/s$ 4)Hydrogenation product of 1-decene trimer produced in Production Example 1 in the presence of a metallocene catalyst, having a 40° C. kinematic viscosity of 14 $mm^2/s$ 5)Hydrogenation product of dimerized oligomer of 1-decene dimer produced in Production Example 2 in the presence of a metallocene catalyst, having a 40° C. kinematic viscosity of 42 $mm^2/s$ 6)Ethylene-propylene copolymer (Lucant 600, product of Mitsui Petrochemical Ind. Ltd.), having a weight average molecular weight of 9,000

7)Ethylene-propylene copolymer (Lucant 600, product of Mitsui Petrochemical Ind. Ltd.), having a weight average molecular weight of 14,000

8)OS 196340, product of Lubrizol

9)PARATORQ 4261, product of Infineum

10)Silicone defoamer

As is clear from Table 1, the compositions of Examples 1 to 3, satisfying formula (I), exhibit a small NOACK evaporation loss amount of 1.6 mass % or less. In contrast, the composition of Comparative Example 1, not satisfying formula (I), exhibits a NOACK evaporation loss amount as large as 5.6 mass.

The Example 1 composition exhibits an excellent fatigue life and an excellent extreme pressure characteristics in the Shell EP test, while the Comparative Example 2 composition is poor ion these properties. The Compositions of Examples 2 and 3 have oxidation stability higher than that of the Comparative Example 1 composition (e.g., kinematic viscosity ratio of −1.0 (40° C.) and −1.2% (100° C.) (Example 2), and 19.9% (40° C.) and 17.4% (100° C.) (Comparative Example 1), or oxidation amount of 1.45 mgKOH/g (Example 2) and 2.77 mgKOH/g (Comparative Example 1)).

Examples 4 to 6 and Comparative Examples 3 to 5

Base oils and additives listed in Table 2 were mixed at proportions shown in Table 2, to thereby prepare transmission fluid compositions. The characteristics and performance of the compositions were determined. Table 2 shows the results.

TABLE 2

| | | | | Examples | | | Comparative Examples | | |
|---|---|---|---|---|---|---|---|---|---|
| | | | | 4 | 5 | 6 | 3 | 4 | 5 |
| Lube oil composition formulation (mass %) | Base oil | PAO-1[1)] | | SI | — | — | 12.6 | — | — |
| | | PAO-2[2)] | | — | — | — | 71.4 | 87.5 | 80.5 |
| | | Ester[3)] | | 6.0 | — | 6.0 | 6.0 | — | 6.0 |
| | | mPAO-1[4)] | | 84.0 | 86.3 | 63.5 | — | — | — |
| | | mPAO-2[5)] | | — | — | 17.0 | — | — | — |
| | mPAO content of base oil | | | (93) | (100) | (93) | (0) | (0) | (0) |
| | Viscosity index improver OCP[6)] | | | 1.0 | | 4.5 | 1.0 | | 4.5 |
| | Viscosity index improver OCP[7)] | | | — | 2.0 | — | — | 0.8 | — |
| | Automatic transmission fluid additive-1 package[8)] | | | 9.0 | — | 9.0 | 9.0 | — | 9.0 |
| | Automatic transmission fluid additive-2 package[9)] | | | — | 11.5 | — | — | 11.5 | — |
| | Other additives[10)] | | | — | 0.2 | — | — | 0.2 | — |
| Properties of lube oil composition | Kinematic viscosity ($mm^2/s$) | | 40° C. | 20.5 | 24.4 | 33.9 | 21.6 | 26.4 | 35.5 |
| | | | 100° C. | 4.69 | 5.37 | 6.85 | 4.79 | 5.45 | 6.97 |
| | Viscosity index | | | 155 | 164 | 166 | 149 | 149 | 162 |
| | BF viscosity [−40° C.] (mPa · s) | | | 2,600 | 3,200 | 6,600 | 3,300 | 4,700 | 8,300 |
| Performance of lube oil composition | NOACK [200° C., 1 hr] (mass %) | | | 1.6 | 1.5 | 1.5 | 5.6 | 1.8 | 1.8 |
| | Fatigue life (min) | | | — | 100 | — | — | 45 | — |
| | Shell EP test 1,800 rpm (N) | | LNL | — | 618 | — | — | 392 | — |
| | | | WL | — | 1,961 | — | — | 1,961 | — |
| | | | LWI | — | 290 | — | — | 216 | — |
| | Oxidation stability test [170° C. × 192 h] | Kinematic viscosity ($mm^2/s$) | 40° C. | 20.0 | | 33.4 | 25.9 | | 40.7 |
| | | | 100° C. | 4.62 | | 6.76 | 5.62 | | 7.87 |
| | | Viscosity index | | 154 | | 166 | 166 | | 168 |
| | | Kinematic viscosity ratio | 40° C. | −2.1 | | −1.4 | 19.9 | | 14.8 |
| | | | 100° C. | −1.5 | | −1.2 | 17.4 | | 13.0 |
| | | Acid value (mgKOH/g) | | 3.54 | | 3.45 | 4.77 | | 4.87 |
| | | Change in acid value (mgKOH/g) | | 1.58 | | 1.45 | 2.77 | | 2.87 |

[Note]

Ingredients 1) to 10) are the same as described in relation to Table 1.

As is clear from Table 2, through comparison of Example 4 with Comparative Example 3, both compositions exhibit a kinematic viscosity as determined at 100° C. of about 4.7 $mm^2/s$. However, the Example 4 composition, which contains mPAO as a main base oil, exhibits a NOACK evaporation loss amount smaller than that of the Comparative Example 3 composition, which does not contain the mPAO (1.6 mass % (Example 4) and 5.6 mass % (Comparative Example 3)) and excellent oxidation stability (e.g., kinematic viscosity ratio of −2.1% (40° C.) and −1.5% (100° C.) (Example 4), and 19.9% (40° C.) and 17.4% (100° C.) (Comparative Example 3), or oxidation amount of 1.58 mgKOH/g (Example 4) and 2.77 mgKOH/g (Comparative Example 3)).

The Example 4 composition exhibits a viscosity index higher than that of Comparative Example 3 composition (155 (Example 4) and 149 (Comparative Example 3)), and a lower BF low-temperature viscosity (2600 mPa (Example 4) and 3300 mPa (Comparative Example 3)).

The compositions of Example 6 and Comparative Example 5 exhibit a kinematic viscosity as determined at 100° C. of about 6.9 $mm^2/s$. However, the Example 6 composition exhibits a small NOACK evaporation loss amount and excellent oxidation stability, viscosity index, and BF low-temperature viscosity, as compared with Comparative Example 3 composition.

The compositions of Example 5 and Comparative Example 4 exhibit almost the same kinematic viscosity as determined at 100° C. of about 5.4 $mm^2/s$. However, the Example 5 composition, which contains mPAO as a main base oil, exhibits a fatigue life longer than that of the Comparative Example 4 composition, which does not contain the mPAO (100 minutes (Example 5) and 45 minutes (Comparative Example 4)), and more excellent extreme pressure characteristics (Shell four ball test). Furthermore, the Example 5 composition exhibits a smaller NOACK evaporation loss amount, a higher viscosity index, and a lower BF low-temperature viscosity, as compared with the Comparative Example 4 composition.

INDUSTRIAL APPLICABILITY

The transmission fluid compositions of the present invention exhibit a very small evaporation loss despite having low viscosity, and a long metal fatigue life (e.g., pitting resistance) and have good extreme pressure properties, and good oxidation stability. Therefore, the compositions of the invention can be effectively utilized as transmission fluid compositions which realize lowering fuel cost and saving energy, and thus serving as countermeasures against global warming.

The invention claimed is:

1. A transmission fluid composition comprising, as a base oil, at least one selected from the group consisting of an α-olefin oligomer and an α-olefin oligomer hydrogenation product, wherein the α-olefin oligomer and the α-olefin oligomer hydrogenation product are at least one species selected from the group consisting of:

(A) a C16 to C40 α-olefin oligomer which has been produced through oligomerization of a C2 to C20 α-olefin in the presence of a metallocene catalyst, and which satisfies formula (II):

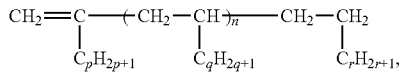

(II)

wherein p, q, and r each are an integer of 0 to 18, n is an integer of 0 to 8, p+n×(2+q)+r is 12 to 36, and when n is ≧2a plurality of q's in individual repeating units may be identical to or different from one another;

(B) a hydrogenation product of the α-olefin oligomer (A) which satisfies formula (III):

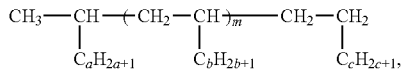

(III)

wherein a, b, and c each are an integer of 0 to 18, m is an integer of 0 to 8, a+m×(2+b)+c is 12 to 36, and when m is ≧2 a plurality of b's in individual repeating units may be identical to or different from one another;

(C) a C16 to C56 α-olefin oligomer which has been produced through dimerization of a C2 to C20 α-olefin in the presence of a metallocene catalyst, to thereby form an α-olefin dimer having a vinylidene bond, and through further dimerization of the α-olefin dimer in the presence of an acid catalyst, and which satisfies formula (IV) or (V):

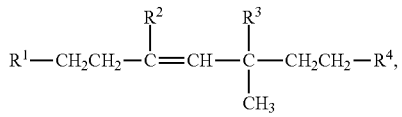

(IV)

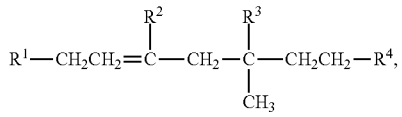

(V)

wherein $R^1$ to $R^4$ each represent a hydrogen atom or a C1 to C18 linear or branched alkyl group, and the total number of carbon atoms in $R^1$ to $R^4$ is 8 to 48;

(D) a hydrogenation product of the α-olefin oligomer (C) which satisfies formula (VI):

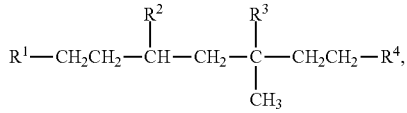

(VI)

wherein $R^1$ to $R^4$ each represent a hydrogen atom or a C1 to C18 linear or branched alkyl group, and the total number of carbon atoms in $R^1$ to $R^4$ is 8 to 48;

(E) a C16 to C40 α-olefin oligomer which has been produced through dimerization of a C2 to C20 α-olefin in the presence of a metallocene catalyst, to thereby form an α-olefin dimer having a vinylidene bond, and through addition of a C6 to C8 α-olefin to the α-olefin dimer in the presence of an acid catalyst, and which satisfies formula (VII):

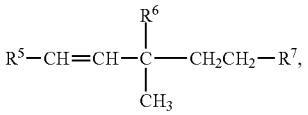

(VII)

wherein $R^5$ represents a C4 to C6 alkyl group; $R^6$ and $R^7$ each represent a hydrogen atom or a C1 to C18 alkyl group, and the total number of carbon atoms in $R^5$ to $R^7$ is 10 to 34; and (F) a hydrogenation product of the α-olefin oligomer (E) which satisfies formula (VIII):

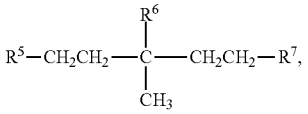

(VIII)

wherein $R^5$ represents a C4 to C6 alkyl group; $R^6$ and $R^7$ each represent a hydrogen atom or a C1 to C18 alkyl group, and the total number of carbon atoms in $R^5$ to $R^7$ is 10 to 34; and wherein said transmission fluid composition has a kinematic viscosity as determined at 100° C. of 2 to 10 $mm^2/s$ and a viscosity index of 150 or higher and which satisfies a relationship between kinematic viscosity and NOACK evaporation loss amount represented by formula (I):

$$X/3+Y \leqq 6.33 \quad (I)$$

wherein X represents a kinematic viscosity ($mm^2/s$) as determined at 100° C., and Y represents a NOACK evaporation loss amount (mass %) at 200° C. for one hour, and wherein the metallocene catalyst is a metallocene complex comprising a Group 4 element and aluminoxane.

2. A transmission fluid composition, comprising a base oil which comprises at least one species selected from the group consisting of:

(A) a C16 to C40 α-olefin oligomer which has been produced through oligomerization of a C2 to C20 α-olefin in the presence of a metallocene catalyst, and which satisfies formula (II):

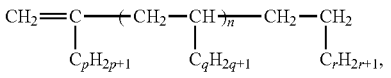

(II)

wherein p, q, and r each are an integer of 0 to 18, n is an integer of 0 to 8, p+n×(2+q)+r is 12 to 36, and when n is ≧2 a plurality of q's in individual repeating units may be identical to or different from one another;

(B) a hydrogenation product of the α-olefin oligomer (A) which satisfies formula

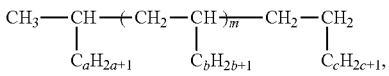

(III)

wherein a, b, and c each are an integer of 0 to 18, m is an integer of 0 to 8, a+m×(2+b)+c is 12 to 36, and when m is ≧2 a plurality of b's in individual repeating units may be identical to or different from one another;

(C) a C16 to C56 α-olefin oligomer which has been produced through dimerization of a C2 to C20 α-olefin in the presence of a metallocene catalyst, to thereby form an α-olefin dimer having a vinylidene bond, and through further dimerization of the α-olefin dimer in the presence of an acid catalyst, and which satisfies formula (IV) or (V):

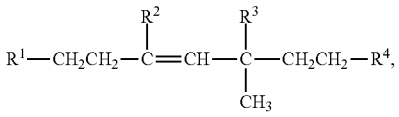

(IV)

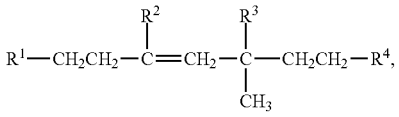

(V)

wherein $R^1$ to $R^4$ each represent a hydrogen atom or a C1 to C18 linear or branched alkyl group, and the total number of carbon atoms in $R^1$ to $R^4$ is 8 to 48;

(D) a hydrogenation product of the α-olefin oligomer (C) which satisfies formula (VI):

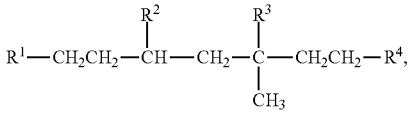

(VI)

wherein $R^1$ to $R^4$ each represent a hydrogen atom or a C1 to C18 linear or branched alkyl group, and the total number of carbon atoms in $R^1$ to $R^4$ is 8 to 48;

(E) a C16 to C40 α-olefin oligomer which has been produced through dimerization of a C2 to C20 α-olefin in the presence of a metallocene catalyst, to thereby form an α-olefin dimer having a vinylidene bond, and through addition of a C6 to C8 α-olefin to the α-olefin dimer in the presence of an acid catalyst, and which satisfies formula (VII):

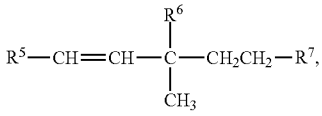

(VII)

wherein $R^5$ represents a C4 to C6 alkyl group; $R^6$ and $R^7$ each represent a hydrogen atom or a C1 to C18 alkyl group, and the total number of carbon atoms in $R^5$ to $R^7$ is 10 to 34; and (F) a hydrogenation product of the α-olefin oligomer (E) which satisfies formula (VIII):

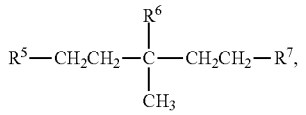

(VIII)

wherein $R^5$ represents a C4 to C6 alkyl group; $R^6$ and $R^7$ each represent a hydrogen atom or a C1 to C18 alkyl group, and the total number of carbon atoms in $R^5$ to $R^7$ is 10 to 34, wherein the metallocene catalyst is a metallocene complex comprising a Group 4 element and aluminoxane.

3. A transmission fluid composition as described in claim 2, wherein the base oil contains at least one species selected from the group consisting of components (A) to (F) in an amount of 10 to 100 mass %.

4. A transmission fluid composition as described in claim 1, which contains at least one species selected from the group consisting of an extreme-pressure agent, an oiliness agent, an antioxidant, a rust-preventive agent, a metal deactivator, a detergent dispersant, a viscosity index improver, a pour point depressant, and a defoamer.

5. A transmission fluid composition as described in claim 1, which has a kinematic viscosity as determined at 100° C. of 3 to 8 $mm^2/s$.

6. A transmission fluid composition as described in claim 2, which has a kinematic viscosity as determined at 100° C. of 2 to 20 $mm^2/s$.

7. A method comprising introducing the transmission fluid composition as described in claim 1 in an automatic transmission.

8. A transmission fluid composition as described in claim 1, wherein the base oil contains at least one species selected from the group consisting of components (A) to (F) in an amount of 10 to 100 mass %.

9. A transmission fluid composition as described in claim 2, which contains at least one species selected from the group consisting of an extreme-pressure agent, an oiliness agent, an antioxidant, a rust-preventive agent, a metal deactivator, a detergent dispersant, a viscosity index improver, a pour point depressant, and a defoamer.

10. A method comprising introducing the transmission fluid composition as described in claim 2 in an automatic transmission.

11. The transmission fluid composition of claim 1, wherein said transmission fluid composition has a kinematic viscosity as determined at 100° C. of 4 to 7 $mm^2/s$ and a viscosity index of 150 or higher, and which satisfies a relationship between kinematic viscosity and NOACK evaporation loss amount represented by formula (I):

$$X/3+Y\leqq 6.33 \quad \text{(I)},$$

wherein X represents kinematic viscosity ($mm^2/s$) as determined at 100° C., and Y represents NOACK evaporation loss amount (mass %) at 200° C. for one hour.

12. A transmission fluid composition comprising at least one bast oil selected from the group consisting of an α-olefin oligomer and an α-olefin oligomer hydrogenation product, wherein the α-olefin oligomer and the α-olefin oligomer hydrogenation product are at lease one species selected from the group consisting of:

(A) a C16 to C40 α-olefin oligomer which has been produced through oligomerization of a C2 to C20 α-olefin in the presence of a metallocene catalyst, and which satisfies formula (II):

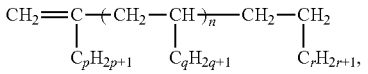

(II)

wherein p, q and r each are an integer of 0 to 18, n is an integer of 0 to 8, p+n×(2+q)+r is 12 to 36, and when n is ≧2 a plurality of q's in individual repeating units may be identical to or different from one another;

(B) a hydrogenation product of the α-olefin oligomer (A) which satisfies formula (III):

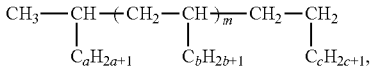

(III)

wherein a, b and c each are an integer of 0 to 18, m is an integer of 0 to 8, a+m×(2+b)+c is 12 to 36, and when m is ≧2 a plurality of b's in individual repeating units may be identical to or different from one another;

(C) a C16 to C56 α-olefin oligomer which has been produced through dimerization of a C2 to C20 α-olefin in the presence of a metallocene catalyst, to thereby form an α-olefin dimer having a vinylidene bond, and through further dimerization of the α-olefin dimer in the presence of an acid catalyst, and which satisfies formula (IV) or (V):

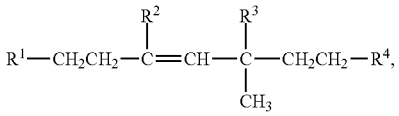

(IV)

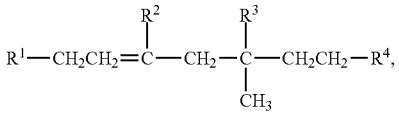

(V)

wherein $R^1$ to $R^4$ each represent a hydrogen atom or a C1 to C18 linear or branched alkyl group, and the total number of carbon atoms in $R^1$ to $R^4$ is 8 to 48;

(D) a hydrogenation product of the α-olefin oligomer (C) which satisfies formula (VI):

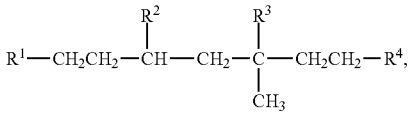

(VI)

wherein $R^1$ to $R^4$ each represent a hydrogen atom or a C1 to C18 linear or branched alkyl group, and the total number of carbon atoms in $R^1$ to $R^4$ is 8 to 48;

(E) a C16 to C40 α-olefin oligomer which has been produced through dimerization of a C2 to C20 α-olefin in the presence of a metallocene catalyst, to thereby form an α-olefin dimer having a vinylidene bond, and through addition of a C6 to C8 α-olefin to the α-olefin dimer in the presence of an acid catalyst, and which satisfies formula (VII):

(VII)

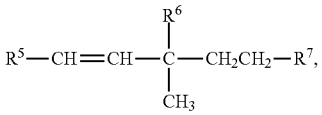

wherein $R^5$ represents a C4 to C6 alkyl group; $R^6$ and $R^7$ each represent a hydrogen atom or a C1 to C18 alkyl group, and the total number of carbon atoms in $R^5$ to $R^7$ is 10 to 34; and (F) a hydrogenation product of the α-olefin oligomer (E) which satisfies formula (VIII):

(VIII)

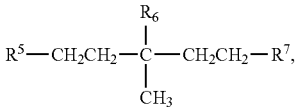

wherein $R^5$ represents a C4 to C6 alkyl group; $R^6$ and $R^7$ each represent a hydrogen atom or a C1 to C18 alkyl group, and the total number of carbon atoms in $R^5$ to $R^7$ is 10 to 34, wherein said transmission fluid composition has a kinematic viscosity as determined at 100° C. of 3 to 8 $mm^2/s$ and a viscosity index of 150 or higher, and which satisfies a relationship between kinematic viscosity and NOACK evaporation loss amount represented by formula (I-a):

$$0.3X+Y \leqq 5.8 \quad \text{(I-a)}$$

wherein X represents kinematic viscosity ($mm^2/s$) as determined at 100° C., and Y represents NOACK evaporation loss amount (% mass) at 200° C. for one hour, and wherein the metallocene catalyst is a metallocene complex comprising a Group 4 element and aluminoxane.

13. A transmission fluid composition comprising at least one base oil selected from the group consisting of an α-olefin oligomer and an α-olefin oligomer hydrogenation product, wherein the α-olefin oligomer and the α-olefin oligomer hydrogenation product are at least one species selected from the group consisting of:

(A) a C16 to C40 α-olefin oligomer which has been produced through oligomerization of a C2 to C20 α-olefin in the presence of a metallocene catalyst and which satisfies formula (II):

(II)

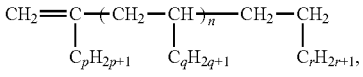

wherein p, q, and r each are an integer of 0 to 18, n is an integer of 0 to 8, p+n×(2+q)+r is 12 to 36, and when n is ≧2 a plurality of q's in individual repeating units may be identical to or different from one another;

(B) a hydrogenation product of the α-olefin oligomer (A) which satisfies formula (III):

(III)

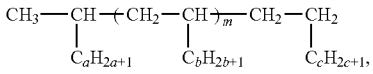

wherein a, b, and c each are integer of 0 to 18, m is an integer of 0 to 8, a+m×(2+b)+c is 12 to 36, and when m is ≧2 a plurality of b's in individual repeating units may be identical to or different from one another;

(C) a C16 to C56 α-olefin oligomer which has been produced through dimerization of a C2 to C20 α-olefin in the presence of a metallocene catalyst to thereby form an α-olefin dimer having a vinylidene bond, and through further dimerization of the α-olefin dimer in the presence of an acid catalyst, and which satisfies formula (IV) or (V):

(IV)

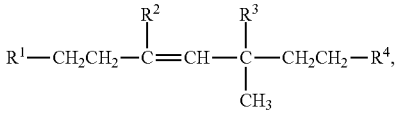

(V)

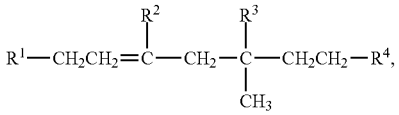

wherein $R^1$ to $R^4$ each represent a hydrogen atom or a C1 to C18 linear or branched alkyl group, and the total number of carbon atoms in $R^1$ to $R^4$ is 8 to 48;

(D) a hydrogenation product of the α-olefin oligomer (C) which satisfies formula (VI):

(VI)

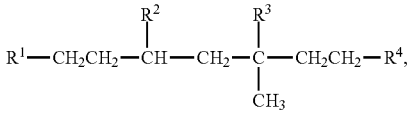

wherein $R^1$ to $R^4$ each represent a hydrogen atom or a C1 to C18 linear or branched alkyl group, and the total number of carbon atoms in $R^1$ to $R^4$ is 8 to 48;

(E) a C16 to C40 α-olefin oligomer which has been produced through dimerization of a C2 to C20 αolefin in the presence of a metallocene catalyst, to hereby form an α-olefin dimer having a vinylidene bond, and through addition of a C6 to C8 α-olefin to the α-olefin dimer in the presence of an acid catalyst, and which satisfies formula (VII):

(VII)

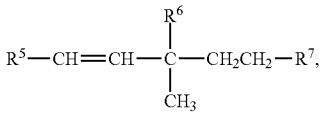

wherein $R^5$ represents a C4 to C6 alkyl group: $R^6$ and $R^7$ each represent a hydrogen atom or a C1 to C18 alkyl group, and the total number of carbon atoms in $R^5$ to $R^7$ is 10 to 34; and (F) a hydrogenation product of the α-olefin oligomer (E) which satisfies formula (VIII):

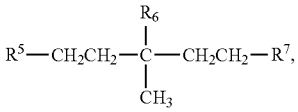

(VIII)

wherein $R^5$ represents a C4 to C6 alkyl group: $R^6$ and $R^7$ each represent a hydrogen atom or a C1 to C18 alkyl group, and the total number of carbon atoms in $R^5$ to $R^7$ is 10 to 34, wherein said transmission fluid composition has a kinematic viscosity as determined at 100° C. of 3 to 8 $mm^2/s$ and a viscosity index of 150 or higher, and which satisfies a relationship between kinematic viscosity and NOACK evaporation loss amount represented by formula (I-b):

$$0.25X+Y \leqq 5.25 \quad \text{(I-b)}$$

wherein X represents kinematic viscosity ($mm^2/s$) as determined at 100° C., and Y represents NOACK evaporation loss amount (% mass) at 200° C. for one hour and wherein the metallocene catalyst is a metallocene complex comprising a Group 4 element and aluminoxane.

14. The transmission fluid composition of claim 1, wherein the metallocene catalyst is a combination of bis(cyclopentadienyl)zirconium dichloride and methylaluminoxane.

15. The transmission fluid composition of claim 2, wherein the metallocene catalyst is a combination of bis(cyclopentadienyl)zirconium dichloride and methylaluminoxane.

16. The transmission fluid composition of claim 1, wherein each of the production of the α-olefin oligomer (A), the dimerization in the production of the α-olefin oligomer (C) and the dimerization in the production of the α-olefin oligomer (E) is performed at 15 to 100° C. under atmosphere pressure to 0.2 MPa for 10 minutes to 48 hours, and a mole ratio α-olefin/metallocene complex is from 1,000 to $10^6$.

17. The transmission fluid composition of claim 2, wherein each of the production of the α-olefin oligomer (A), the dimerization in the production of the α-olefin oligomer (C) and the dimerization in the production of the α-olefin oligomer (E) is performed at 15 to 100° C. under atmosphere pressure to 0.2 MPa for 10 minutes to 48 hours, and a mole ratio α-olefin/metallocene complex is from 1,000 to $10^6$.

18. The transmission fluid composition of claim 1, wherein the metallocene catalyst is a combination of bis(cyclopentadienyl)zirconium dichloride and methylaluminoxane, and wherein each of the production of the α-olefin oligomer (A), the dimerization in the production of the α-olefin oligomer (C) and the dimerization in the production of the α-olefin oligomer (E) is performed at 15 to 100° C. under atmosphere pressure to 0.2 MPa for 10 minutes to 48 hours, and a mole ratio α-olefin/metallocene complex is from 1,000 to 106.

19. The transmission fluid composition of claim 2, wherein the metallocene catalyst is a combination of bis(cyclopentadienyl)zirconium dichloride and methylaluminoxane, and wherein each of the production of the α-olefin oligomer (A), the dimerization in the production of the α-olefin oligomer (C) and the dimerization in the production of the α-olefin oligomer (E) is performed at 15 to 100° C. under atmosphere pressure to 0.2 MPa for 10 minutes to 48 hours, and a mole ratio α-olefin/metallocene complex is from 1,000 to 106.

* * * * *